US009101847B2

(12) United States Patent
Hoeting

(10) Patent No.: US 9,101,847 B2
(45) Date of Patent: Aug. 11, 2015

(54) SHAPE CHANGING APPARATUS AND METHOD

(71) Applicant: BANG ZOOM design, Ltd., Cincinnati, OH (US)

(72) Inventor: Michael G. Hoeting, Cincinnati, OH (US)

(73) Assignee: Bang Zoom Design, Ltd., Cincinnati, OH (US)

( * ) Notice: Subject to any disclaimer, the term of this patent is extended or adjusted under 35 U.S.C. 154(b) by 176 days.

(21) Appl. No.: 13/832,370

(22) Filed: Mar. 15, 2013

(65) Prior Publication Data

US 2014/0273724 A1 Sep. 18, 2014

(51) Int. Cl.

| | |
|---|---|
| ***A63H 3/20*** | (2006.01) |
| ***A63H 11/06*** | (2006.01) |
| ***A63H 33/00*** | (2006.01) |

(52) U.S. Cl.

CPC ..... *A63H 11/06* (2013.01); *A63H 3/20* (2013.01); *A63H 33/003* (2013.01)

(58) Field of Classification Search

USPC ..... 446/330, 376, 379, 487

See application file for complete search history.

(56) References Cited

U.S. PATENT DOCUMENTS

| | | | | |
|---|---|---|---|---|
| 4,324,065 | A | 4/1982 | Cooper | |
| 5,090,569 | A * | 2/1992 | Nissen et al. | 206/457 |
| 5,310,378 | A * | 5/1994 | Shannon | 446/268 |
| 5,924,910 | A * | 7/1999 | Liu | 446/470 |
| 6,761,612 | B1 | 7/2004 | Pencil et al. | |
| 7,217,170 | B2 | 5/2007 | Moll et al. | |
| 7,731,563 | B2 * | 6/2010 | Saucier | 446/487 |
| 2010/0252990 | A1 | 10/2010 | Yamada et al. | |

FOREIGN PATENT DOCUMENTS

| | | | |
|---|---|---|---|
| CN | 201275421 | Y | 7/2009 |
| WO | 02064230 | A1 | 8/2002 |

OTHER PUBLICATIONS

Partial Search Report/Annex to Invitation to Pay Additional Fees in corresponding International Patent Application No. PCT/US2014/027092, mailed Jul. 14, 2014, 2 pgs.

International Search Report and Written Opinion in corresponding International Patent Application No. PCT/US2014/027092, mailed Sep. 30, 2014, 14 pgs.

* cited by examiner

*Primary Examiner* — John Ricci

(74) *Attorney, Agent, or Firm* — Wood, Herron & Evans, L.L.P.

(57) ABSTRACT

A shape changing apparatus includes a body portion and first and second appendages pivotally attached to respective first and second opposing sides of the body portion so as to be rotatable about respective first and second axes of rotation. The first and second appendages are moveable between an open position and a closed position. Each appendage has a generally arcuate shape. The shape changing apparatus further includes a biasing mechanism coupled to the first and second appendages. The biasing mechanism is configured to bias the first and second appendages to the open position. The shape changing apparatus further includes a release mechanism operatively coupled to one of the first or second appendages. Upon activating the release mechanism the biasing mechanism pivots the first and second appendages to the open position.

25 Claims, 16 Drawing Sheets

SHAPE CHANGING APPARATUS AND METHOD

TECHNICAL FIELD

This invention generally relates to a shape changing apparatus, and more particularly, to shape-changing toy apparatus, assembly, and methods of use.

BACKGROUND

Although there are many toys on the market, manufacturers constantly seek new ways to make toys that are more entertaining and amusing. Often, children are particularly interested in toys having moving parts. Mechanical aspects of toys are intellectually stimulating to children as they must learn how to operate the toy, and they may experience curiosity as to how the toy works. Moreover, toys requiring user operation help children to develop fine motor skills.

In addition to making toys appealing to children, toy manufacturers must also market them to parents. For example, many parents are interested in relatively inexpensive toy options. Children may sometimes grow bored or "grow out of" toys, and, thus, parents may be hesitant to spend a great deal of money on a particular toy. Parents may also be interested in purchasing relatively small toys that do not require much storage space. Moreover, relatively small toys may be carried with the child to keep him or her occupied during trips or errands outside the home. For example, small toys may be carried in a mother's purse to occupy children "on the go."

SUMMARY OF THE INVENTION

According to one embodiment of the invention, a shape changing apparatus includes a body portion having first and second opposing sides. The shape changing apparatus further includes first and second appendages pivotally attached to respective first and second sides of the body portion so as to be rotatable about respective first and second axes of rotation. The first and second appendages are moveable between an open position and a closed position. Each appendage has a generally arcuate shape. The shape changing apparatus further includes a biasing mechanism coupled to the first and second appendages. The biasing mechanism is configured to bias the first and second appendages to the open position. The shape changing apparatus further includes a release mechanism operatively coupled to one of the first or second appendages. Upon activating the release mechanism the biasing mechanism pivots the first and second appendages to the open position.

According to another embodiment of the invention, a shape changing apparatus includes first and second appendages pivotally attached to one another about a common axis of rotation. The first and second appendages are moveable between an open position and a closed position. Each appendage has a generally arcuate shape. The shape changing apparatus further includes a biasing mechanism having first and second ends coupled to respective first and second appendages. The biasing mechanism is configured to bias the first and second appendages to the open position. The shape changing apparatus further includes a release mechanism operatively coupled to one of the first or second appendages. The release mechanism has a retention mechanism to help secure the first and second appendages in the closed position. Upon activating the release mechanism the biasing mechanism pivots the first and second appendages to the open position.

According to yet another embodiment of the invention, an assembly includes a shape changing apparatus and a launching dock. The shape changing apparatus includes first and second appendages pivotally attached to one another about a common axis of rotation. The first and second appendages are moveable between an open position and a closed position. Each appendage has a generally arcuate shape. The shape changing apparatus further includes a biasing mechanism having first and second ends coupled to respective first and second appendages. The biasing mechanism is configured to bias the first and second appendages to the open position. The shape changing apparatus further includes at least one retention tab positioned on one of the first and second appendages. The launching dock includes an apparatus retention mechanism configured to cooperate with the retention tab for securing the apparatus to the launching dock while the first and second appendages are in the closed position. The apparatus retention mechanism has an actuator for selectively releasing the retention mechanism to permit the first and second appendages to move from the closed position to the open position, which launches the apparatus from the launching dock.

According to an embodiment of the invention, a method is provided for operating a shape changing apparatus. The shape changing apparatus includes a body portion having first and second opposing sides and first and second appendages attached to respective first and second sides of the body so as to be rotatable about respective first and second axes of rotation. The first and second appendages are moveable between an open position and a closed position. Each appendage has a generally arcuate shape. The shape changing apparatus further includes a biasing mechanism having first and second ends coupled to respective first and second appendages. The biasing mechanism is configured to bias the first and second appendages to the open position. The shape changing apparatus further includes a release mechanism operatively coupled to one of the first and second appendages. The method includes the steps of positioning the body portion adjacent a generally cylindrically object and moving at least one of the first and second appendages into the closed position such that the first and second appendages at least partially encircle the generally cylindrical object and the biasing mechanism is stretched. The method further includes the step of activating the release mechanism such that the biasing mechanism pivots the first and second appendages to the open position.

According to another method of operating a shape changing apparatus of the present invention, the shape changing apparatus has first and second appendages pivotally attached to one another about a common axis of rotation. Each appendage has a generally arcuate shape. The first and second appendages are moveable between an open position and a closed position. The shape changing apparatus further includes a biasing mechanism having first and second ends coupled to respective first and second appendages. The biasing mechanism is configured to bias the first and second appendages to the open position. The shape changing apparatus further includes a release mechanism operatively coupled to one of the first or second appendages. The method includes the steps of positioning the shape changing apparatus adjacent a generally cylindrically object and moving at least one of the first and second appendages into the closed position such that the first and second appendages at least partially encircle the generally cylindrical object. The method further includes the step of activating the release mechanism such that the biasing mechanism pivots the first and second appendages to the open position.

According to yet another method of operating an assembly having a shape changing apparatus, the shape changing apparatus includes first and second appendages pivotally attached to one another about a common axis of rotation. The first and second appendages are moveable between an open position and a closed position. Each appendage has a generally arcuate shape. The shape changing apparatus further includes a biasing mechanism coupled to the first and second appendages. The biasing mechanism is configured to bias the first and second appendages to the open position. The shape changing apparatus further includes at least one retention tab positioned on at least one of the first and second appendages. The assembly further includes a launching dock having an apparatus retention mechanism configured to cooperate with the retention tab. The apparatus retention mechanism also has an actuator for selectively releasing the retention mechanism. The method includes the steps of positioning the shape changing apparatus adjacent the launching dock, moving at least one of the first and second appendages into the closed position such that the first and second appendages at least partially encircle the launching dock, and securing the retention tab in the retention mechanism when the first and second appendages are in the closed position. The method further includes the step of actuating a release of the retention member such that the biasing mechanism pivots the first and second appendages to the open position, which launches the apparatus from the launching dock.

BRIEF DESCRIPTION OF THE DRAWINGS

The accompanying drawings, which are incorporated in and constitute a part of this specification, illustrate embodiments of the invention and, together with the detailed description of the embodiments given below, serve to explain the principles of the invention.

DETAILED DESCRIPTION

Figure 1:
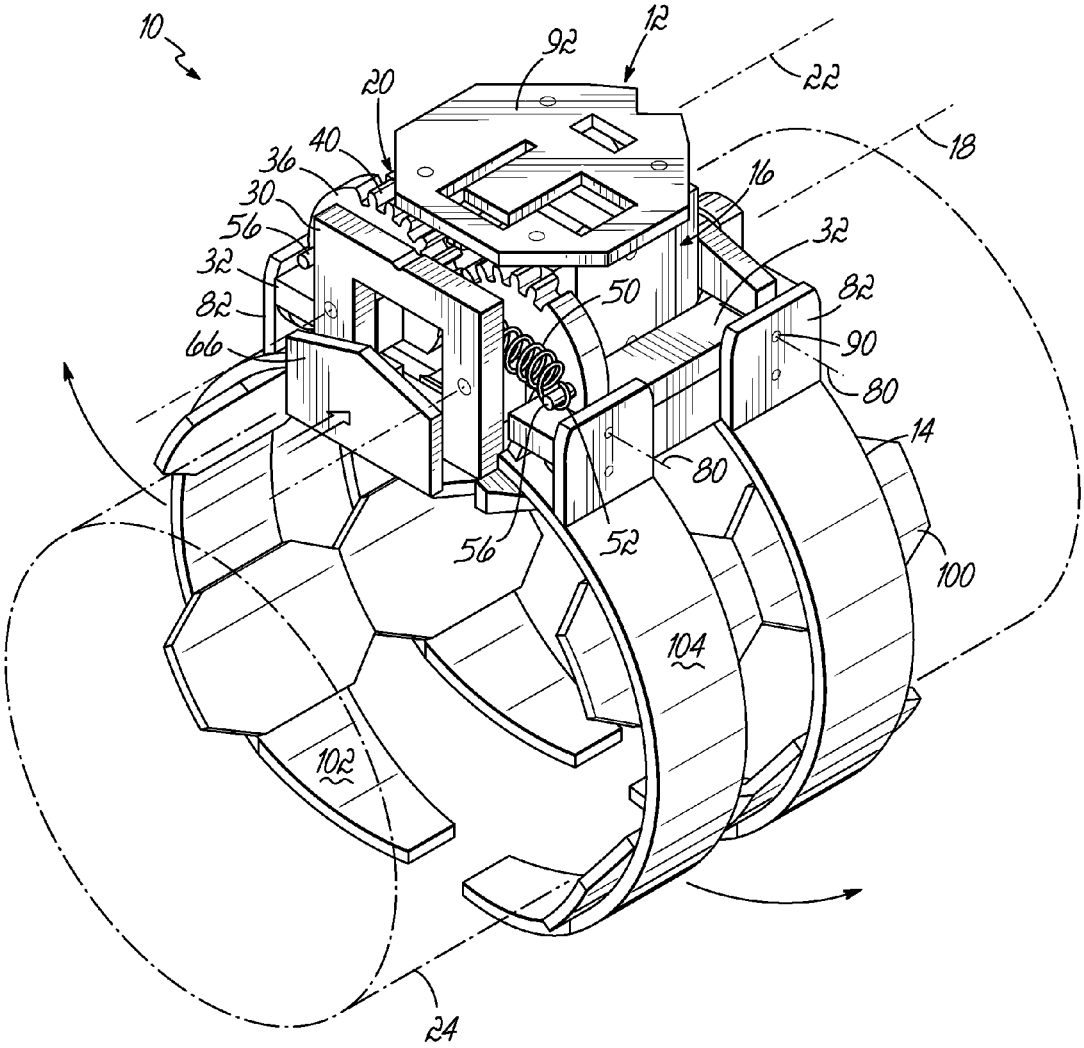
FIG. 1 is a perspective view of a shape changing apparatus in a closed position in accordance with one embodiment of the invention.

With reference to FIGS. 1-7B, an embodiment of a shape changing apparatus 10 is shown. In keeping with the spirit of the invention, the shape changing apparatus will be referred as a toy, but the use of that term is not intended to be limiting in any way. The toy 10 has a body portion 12 and a plurality of appendages 14 extending therefrom. More specifically, two appendages 14 are pivotally attached to one side 16 of the body portion 12 at an axis of rotation 18 and two appendages 14 are pivotally attached to an opposing side 20 of the body portion 12 at a different axis of rotation 22. The appendages 14 are moveable about the axes of rotation 18, 22 between a closed position in which the appendages 14 are configured to be positioned on an object 24 and an open position. The two axes of rotation 18, 22 are generally located in a common plane.

In general, the body portion 12 includes a housing 30 and components positioned therein. The body portion 12 is positioned centrally on the toy 10. Although the body portion 12 is shown having a generally rectangular shape, one of ordinary skill will recognize that the shape and dimensions of the body portion 12 may vary. For example, in an embodiment, the body portion 12 may be rounded so as to form a dome shape. The body portion 12 may further be decorated or designed, as will further be described below.

The appendages 14 are generally arcuately shaped to fit around object 24 that supports the toy 10 in a closed position. Cylindrical object 24 could be any generally cylindrical shape like a body part, such as a wrist, an arm, a finger, a leg, and/or an ankle. However, a wide variety of objects may serve as the support. One of ordinary skill will recognize that toy 10 may comprise any number of appendages 14, including more or less than the four shown in the figures. Moreover, it is not necessary that the appendages 14 be positioned symmetrically on the body portion 12. For example, one side 16 of the body portion 12 may have a greater number of appendages 14 extending therefrom than the other side 20 of the body portion 12.

In the embodiment shown in FIGS. 1-7B the appendages 14 on one side 16 of the body portion 12 are coupled to a pivot mechanism 32. The appendages 14 on the other side 20 of the body portion 12 are operatively coupled to an opposing pivot mechanism 32. Each pivot mechanism 32 includes a leaf 34 to which the appendages 14 are coupled and an intermeshing gear 36. The intermeshing gears 36 of the two pivot mechanisms 32 cooperate via corresponding teeth 40 such that the appendages 14 on both sides 16, 20 of the body 14 move in unison between the open and closed positions. The intermeshing gears 36 rotate about axles 38.

Figure 7A:
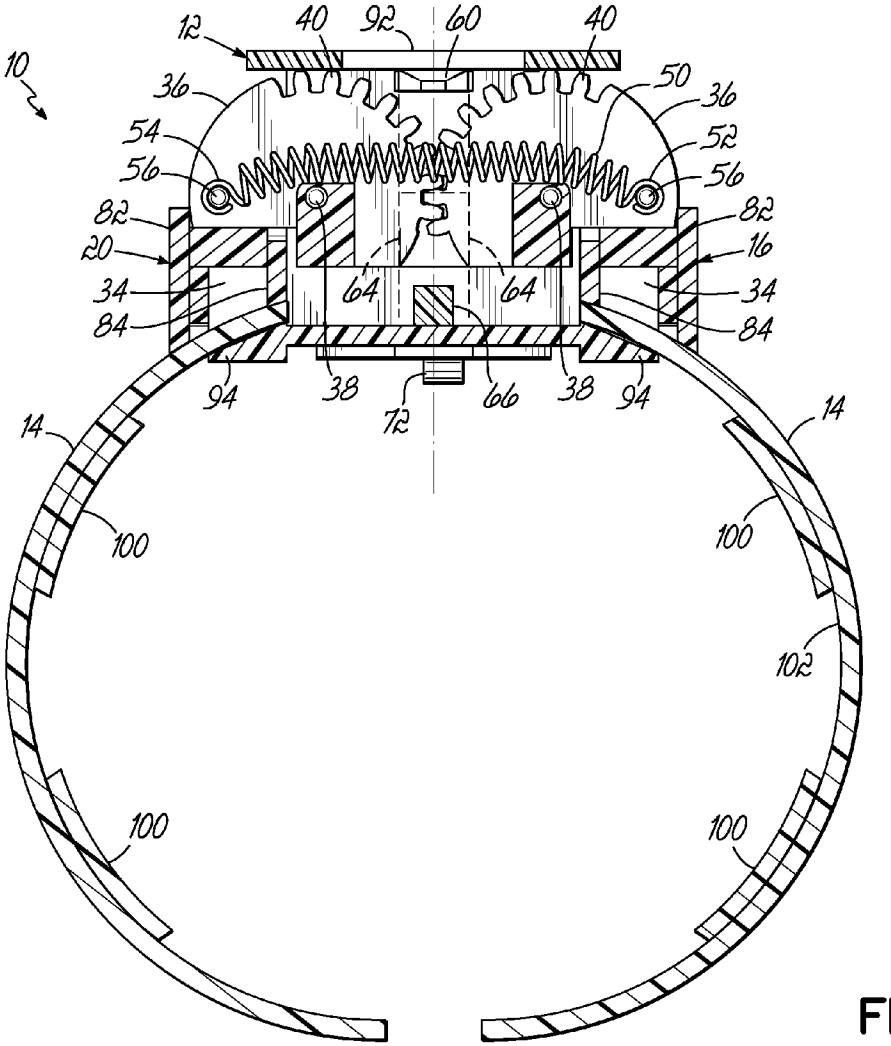
FIG. 7A is yet another cross section view of the apparatus of FIG. 1.
Figure 7B:
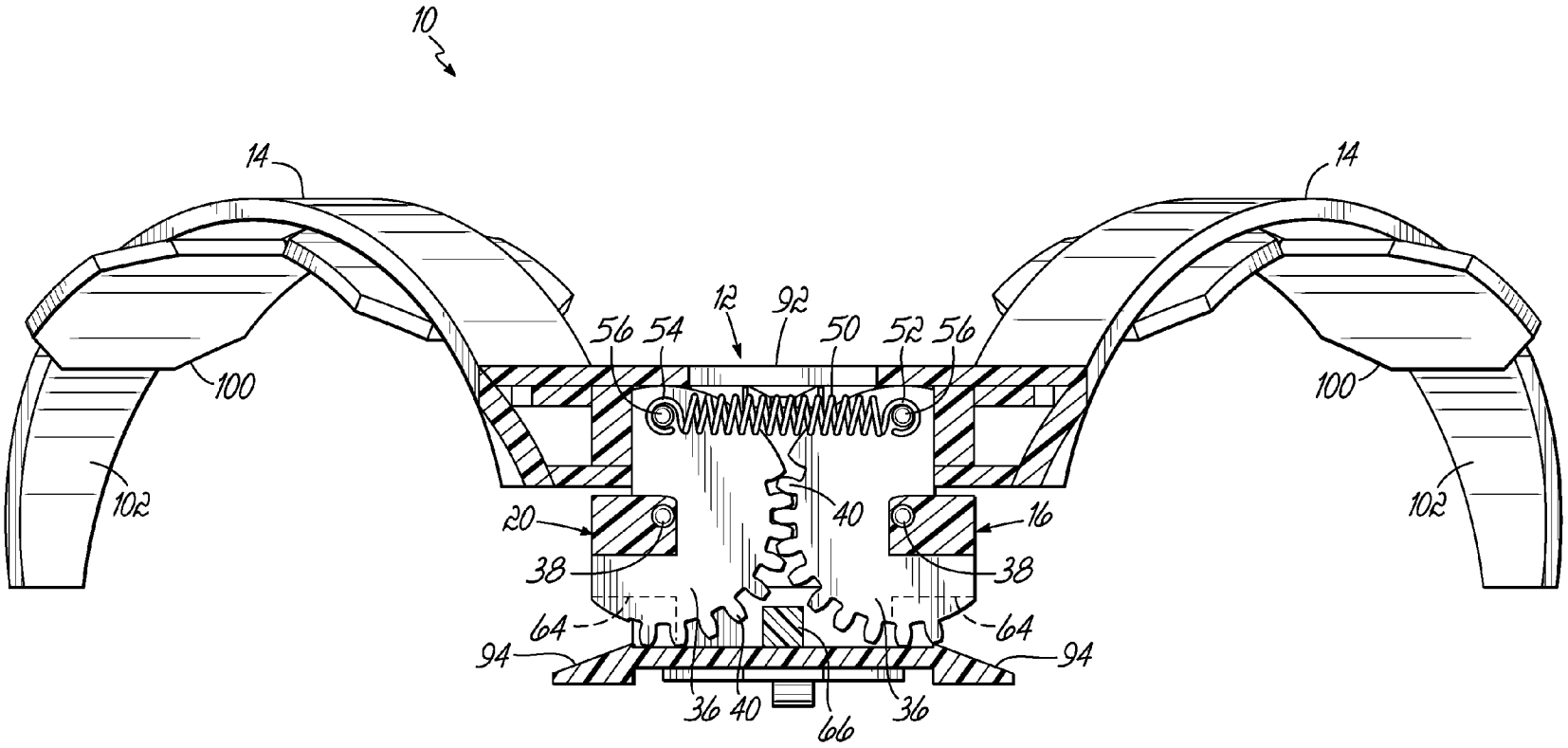
FIG. 7B is yet another cross section view of the apparatus of FIG. 1.

With reference now to FIGS. 7A and 7B, a biasing mechanism 50, such as a helical or coil spring, is located in the body portion 14 of the toy 10. The biasing mechanism 50 has two ends 52, 54, one end 52 is coupled to appendage 14 extending from one side 16 of the body 14 and the other end 54 is coupled to appendage 14 extending from another side 20 of the body 14. The ends 52, 54 of the biasing mechanism 50 may be coupled to the appendages 14 with pins 56, screws, or any other suitable means recognized by one of ordinary skill. The biasing mechanism 50 is positioned above the plane in which the axes of rotation 18, 22 lie, and the biasing mechanism 50 is positioned substantially perpendicular to each axis of rotation 18, 22. While the biasing mechanism 50 is shown as a helical or coil spring, the biasing mechanism 50 may comprise any type of spring (e.g., a helical spring, flat spring, torsion spring, etc.), an elastic band, a hydraulic pusher, or any other suitable mechanism recognized by one of ordinary skill to exert a biasing force. Moreover, the biasing mechanism 50 may be constructed from a variety of suitable materials.

The biasing mechanism 50 is configured to bias the appendages 14 to the open position. The biasing mechanism 50 should be pre-loaded prior to being coupled to the appendages 14 so that appendages 14 stay in the open position until an external force is applied. In order to rotate the appendages 14 from the open to the closed position, a force greater than the biasing force must be applied.

With reference now to FIG. 7A, when the appendages 14 are in the closed position, the biasing mechanism 50 is stretched between the pins 56. A force vector of the biasing mechanism 50 is slightly above the plane in which the axes of rotation 18, 22 lie, although it is closer to the plane than in the open position (FIG. 7B). In this embodiment, the biasing mechanism 50 is curved above axles 38 of the intermeshing gears 36. In this way, the biasing mechanism 50 remains set to bias the appendages 14 to the open position due to the position of the biasing mechanism 50 vector relative to the axes of rotation 18, 22. In the fully closed position, because the biasing mechanism 50 is stretched and the vector is so close to the axes of rotation 18, 22, little force is required to release the biasing mechanism 50 and move the appendages 14 toward the open position.

Figure 4:
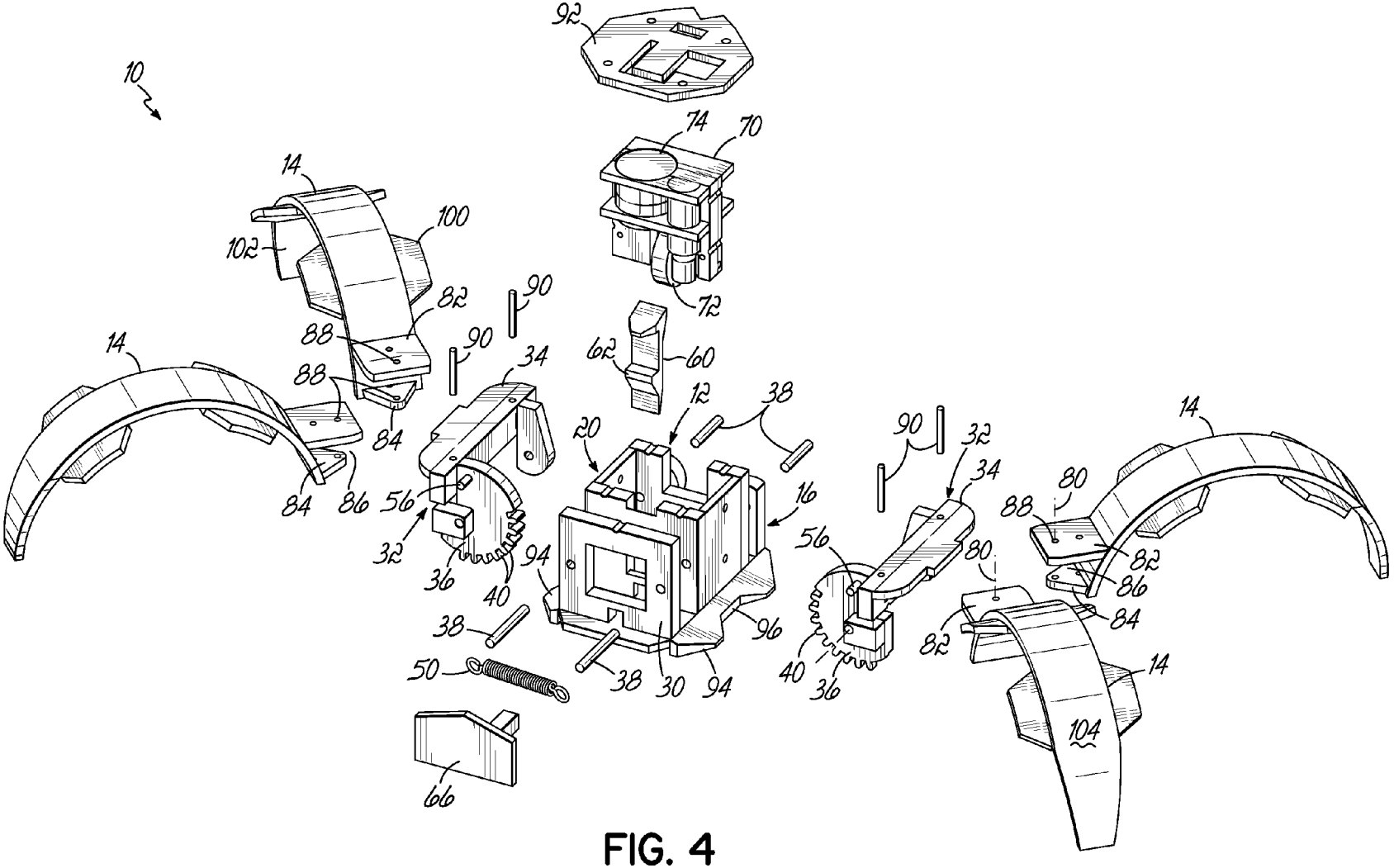
FIG. 4 is an exploded view of the apparatus of FIG. 1.
Figure 5A:
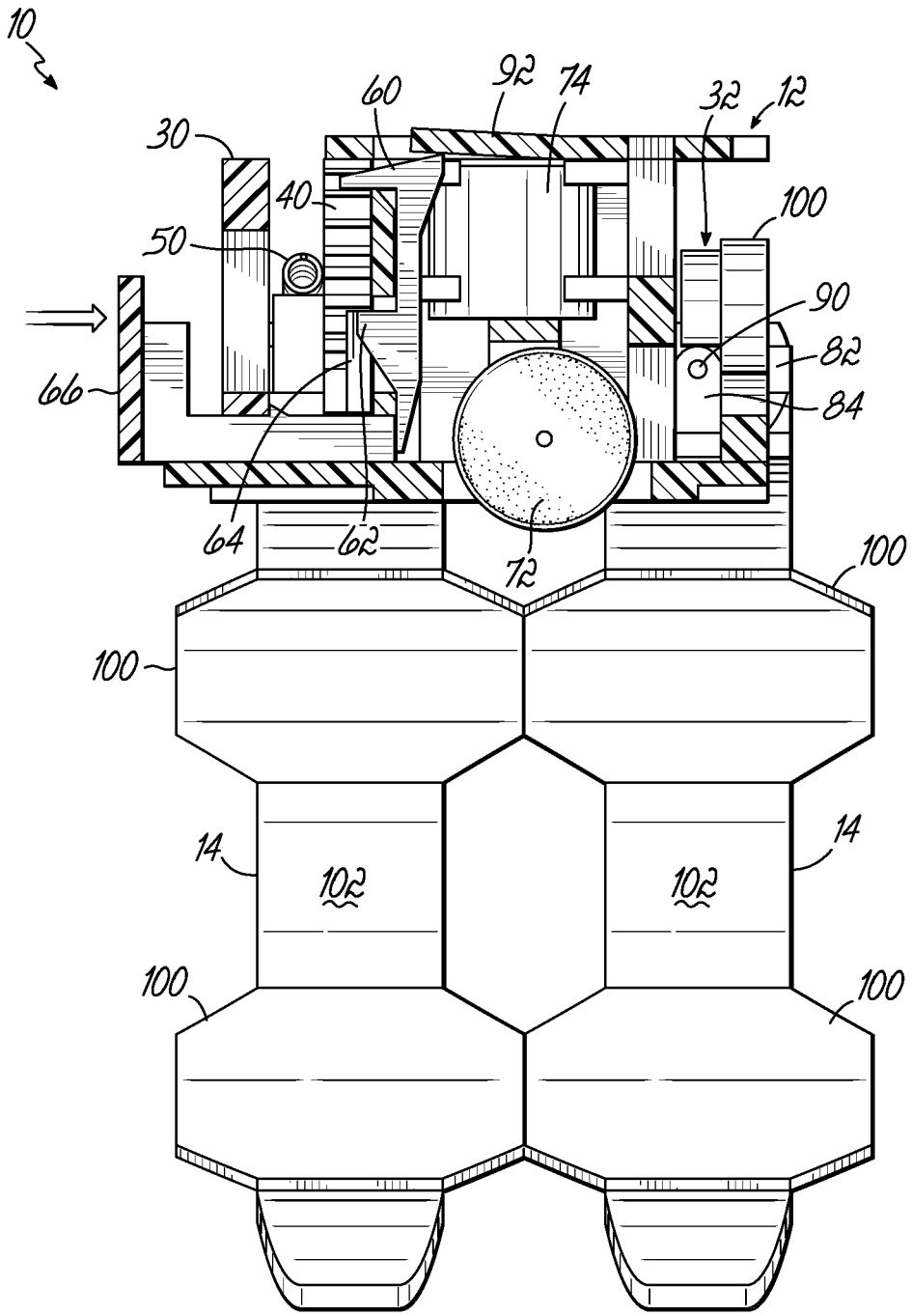
FIG. 5A is cross section view of the apparatus of FIG. 1.
Figure 5B:
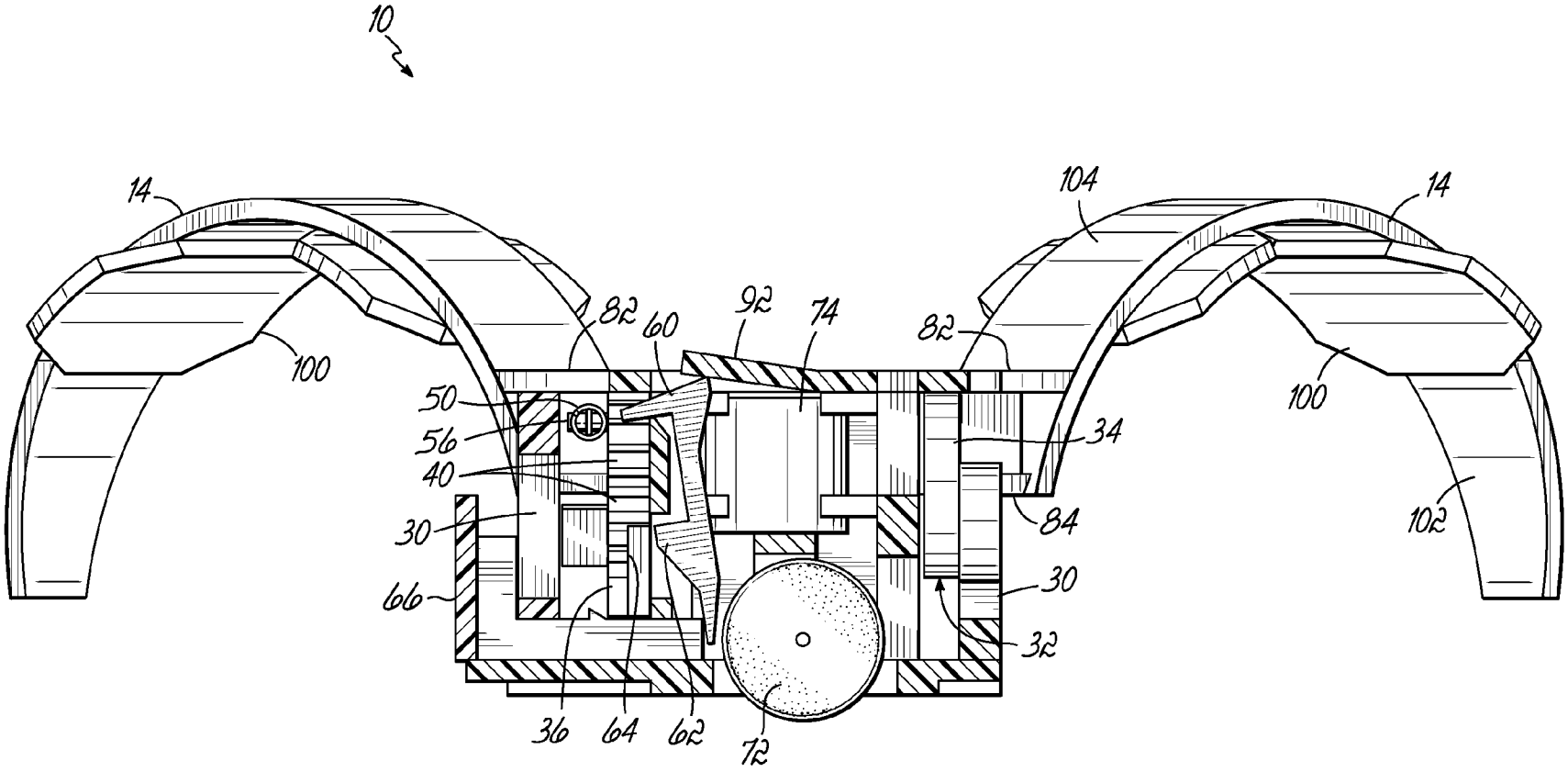
FIG. 5B is another cross section view of the apparatus of FIG. 1.
Figure 6:
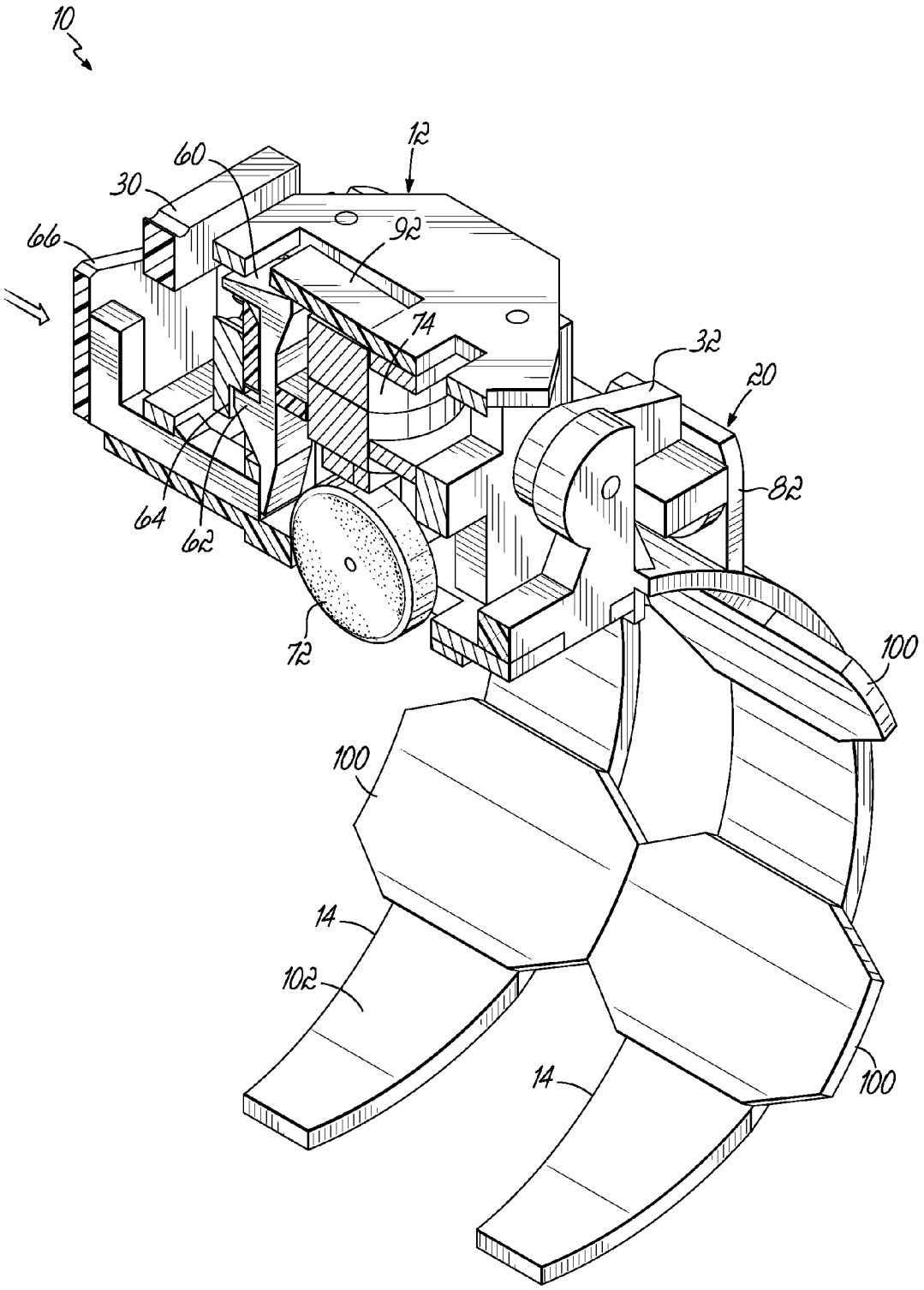
FIG. 6 is yet another cross section view of the apparatus of FIG. 1.

With specific reference now to FIGS. 4, 5A, 5B, and 6, body portion 12 further includes a retention mechanism 60 to help secure the appendages 14 in the closed position. In other words, once the appendages 14 are rotated to the closed position, the retention mechanism 60 locks or secures them in closed position. In this way, the retention mechanism 60 prevents the biasing mechanism 50 from biasing the appendages 14 to the open position. The retention mechanism 60 is positioned behind the intermeshing gears 36 and biased toward the intermeshing gears 36 by a top plate 92 (described in further detail below) of the body portion 12. The retention mechanism 60 includes a latch 62 that is biased toward and is configured to interact with at least one of the intermeshing gears 36. A recess in a back surface of each intermeshing gear 36 forms half of a notch 64. When the intermeshing gears 36 are fully rotated to the closed position, the two halves effectively operate as notch 64, which generally corresponds in size and shape to the latch 62. In an alternative embodiment, the notch 64 may be positioned on a single intermeshing gear 36. When the appendages 14 are rotated to the closed position, the latch 62 is biased into contact with the notch 64 so as to prevent rotation of the intermeshing gears 36. FIG. 5B shows that the latch 62 does not interfere with the intermeshing gears 36 when the appendages 14 are in the open position. FIGS. 5A and 6, on the other hand, show the latch 62 positioned within the notch 64 so as to prevent movement of the intermeshing gears 36 when the appendages 14 are in the closed position.

The body 12 further includes a release mechanism 66 operatively coupled to the retention mechanism 60. The release mechanism 66 is configured to provide for selective release or unlocking of the retention mechanism 60 so as to enable the appendages 14 to move from the closed position to the open position. When the toy 10 is positioned on the generally cylindrical object 24 and the appendages 14 are moved from the closed position to the open position, the toy 10 jumps or launches off of the generally cylindrical object 24. The release mechanism 66 may comprise a button that is operatively coupled to the latch 62. In the embodiment shown, when the button 66 is pushed inwardly (i.e., toward a center of the body 12), an extension on the button 66 forces the latch 62 out of contact with the notch 64 of the intermeshing gears 36, allowing the intermeshing gears 36 to rotate as the biasing mechanism 50 biases the appendages 14 to the open position. Although one of ordinary skill will recognize that a configuration of the release mechanism 66 may vary, it should be positioned on the body 12 and configured such that activation by an operator's finger will not interfere with or prevent the toy 10 from launching off of the generally cylindrical object 24. For this reason, the embodiment shows a release mechanism 66 that is activated by applying a force substantially parallel to the axes of rotation 18, 22 so that the finger does not restrict upward movement of the toy 10. FIGS. 5A and 6 show an unactivated release mechanism 66, in which the latch 62 remains in contact with the notch 64 of the intermeshing gears 36 and the appendages 14 are in the closed position. In FIG. 5B, however, the release mechanism 66 has been activated, i.e., pushed inwardly, so as to push the latch 62 out of contact with the intermeshing gears 36 such that the appendages 14 are biased to the open position.

The body portion 12 further includes a motor 70 and a drive wheel 72 operatively coupled to the motor 70. The motor 70 may have an off/on switch (not shown) that is accessible from an exterior of the body portion 12. The motor 70 is operatively connected to a battery 74 or other power source for powering motion of the drive wheel 72. The drive wheel 72 extends at least partially out of the body portion 12 so it can contact a support surface when the appendages 14 are in the open position. The drive wheel 72 is configured to propel the toy 10 across the support surface after the toy 10 is launched from the generally cylindrical object 24 and the appendages 14 moved from the closed position to the open position. The motor 70 further includes a switch (not shown) operatively connected thereto and configured to deactivate the motor 70 when the first and second appendages 14 are in the closed position. In this way, the motor 70 is activated, and thus, the drive wheel 72 propels the toy 10, only when the appendages 14 are in the open position.

Figure 2:
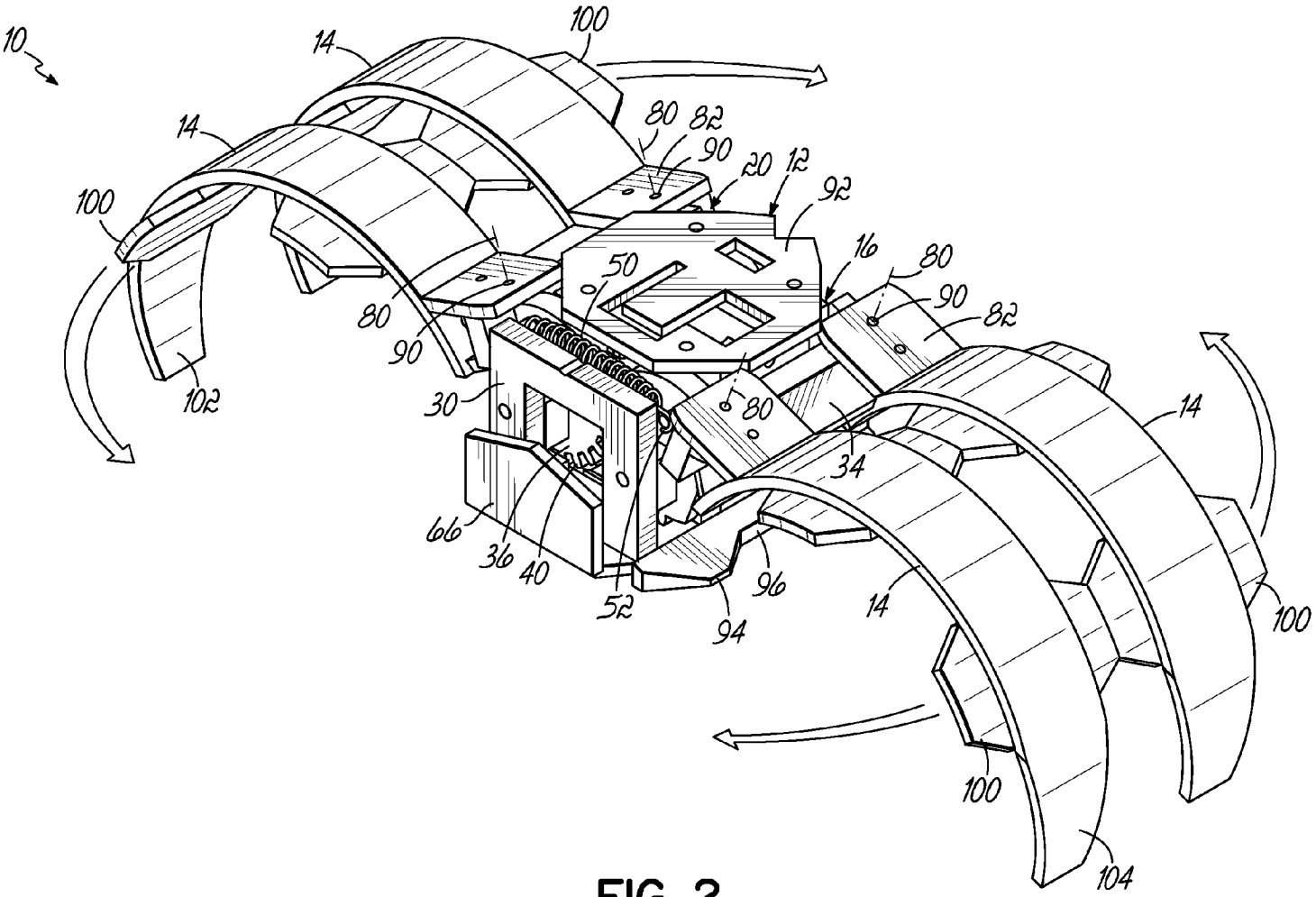
FIG. 2 is a perspective view of the apparatus of FIG. 1 in an intermediate position.
Figure 3:
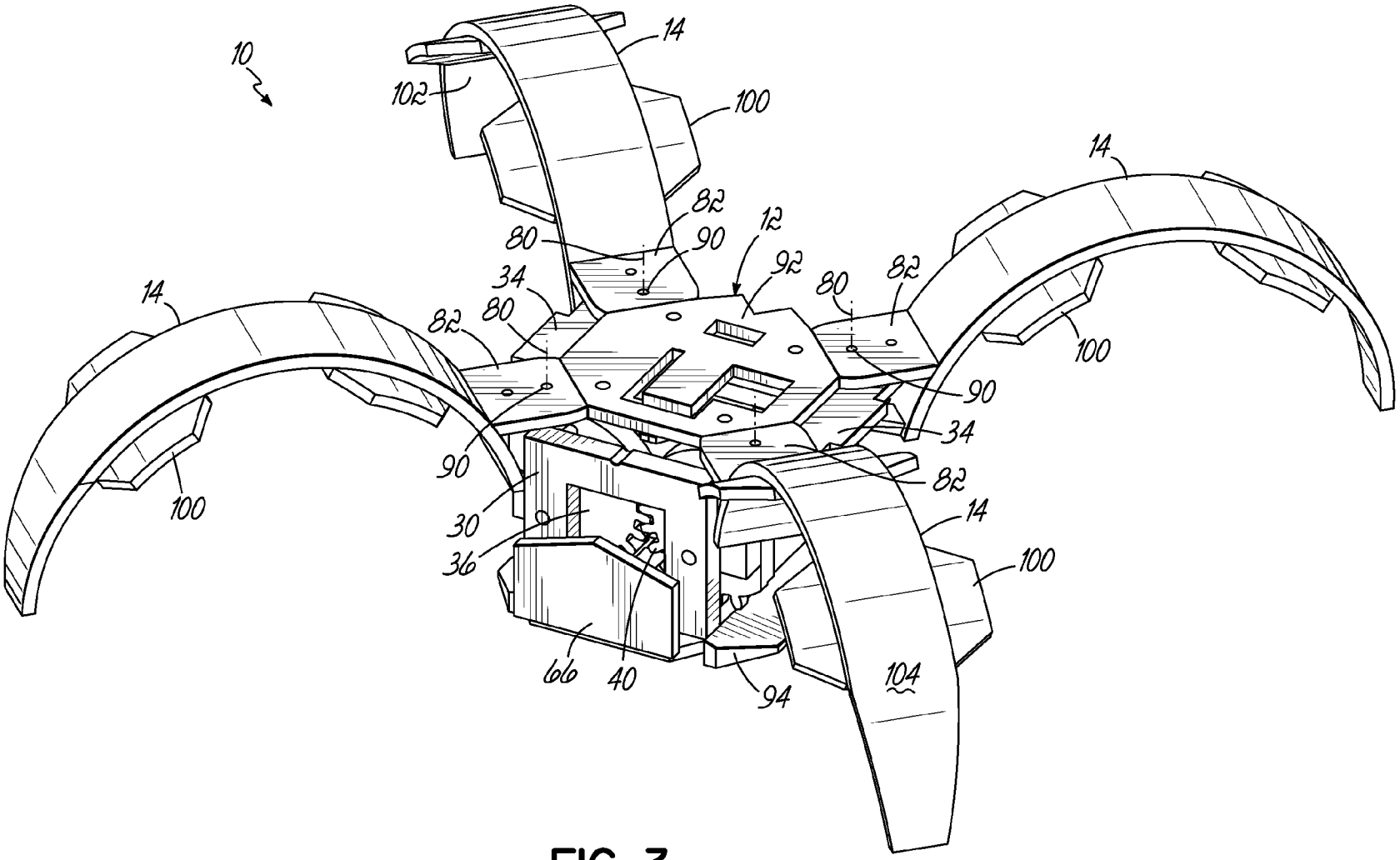
FIG. 3 is a perspective view of the apparatus of FIG. 1 in an open position.
Figure 3A:
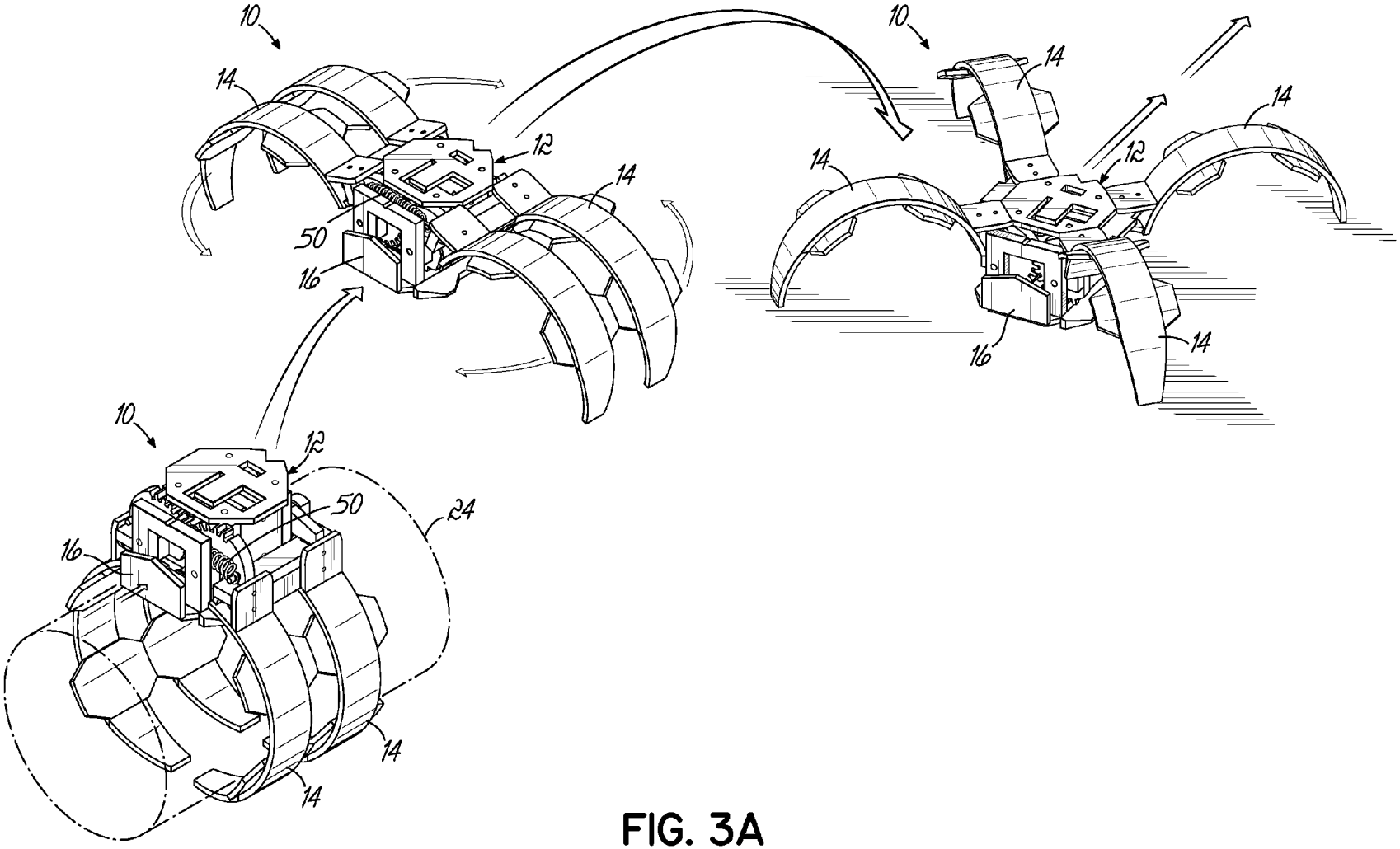
FIG. 3A is a perspective view of the apparatus of FIG. 1 as the apparatus converts from the closed position to the open position.

With specific reference now to FIGS. 2, 3A, and 4, in addition to being rotatable about the axes of rotation 18, 22, each appendage 14 is pivotable about a different axis 80. As shown in FIG. 4, a proximal end of the appendages 14 (i.e., the end closest to the body 12 when the appendages 14 are in the open position) have upper and lower projections 82, 84 by which the appendage 14 is attached to the body portion 12. The upper and lower projections 82, 84 are in spaced relation to one another on the appendage 14. A space 86 between the upper and lower projections 82, 84 may be configured to accept therein at least a portion of the leaf 34 of the pivot mechanism 32. The upper and lower projections 82, 84 each have an aperture 88 extending therethrough. The appendages 14 are coupled to the body portion 12 via a pin 90 that extends through the aperture 88 in the upper projection 82, through an aperture 88 in the leaf 34, and through the aperture 88 on the lower projection 84. For simplicity purposes, without limiting the appendages 14 to specific rotational configurations, rotation about the axes 18, 22 may be referred to as "vertical rotation," and rotation about the axes 80 may be referred to as "lateral rotation."

As shown in FIGS. 2, 3A, and 4, each appendage 14 is configured to laterally rotate between a position angled from the body 12 (FIG. 3) in the open position and a position adjacent the other appendage 14 on the same side 16, 20 of the body 12 in the closed position (FIG. 2). Angled sides of a top plate 92, which is secured on the body 12 above the pivot mechanisms 32, correspond to the upper projection 82 on the appendages 14, and the relative fit between the upper projection 14 and the angled top plate 92 dictate the angle at which the appendages 14 are positioned in the open position. In the closed position, a leaf 94 extending from a bottom of the body portion 12 housing 30 includes a recess 96 in which the lower projections 84 of the appendages 14 are positioned in the closed position. This recess 96 "traps" the appendages 14 adjacent one another in the closed position until the release mechanism 66 is activated.

With further reference to the embodiment shown in FIGS. 2, 3A, and 4, the appendages 14 on a same side 16, 20 of the body 12 are coupled together so that they move in unison between the open and closed positions with respect to vertical and/or lateral rotation. In this way, when one appendage 14 on one side 16 (or 20) of the body 12 is rotated downward, the other appendage 14 on that side 16 of the body 12 also rotates downward as well and/or when one appendage 14 on that side 16 of the body 12 rotates inward, the other appendage 14 on that side 16 of the body 12 also rotates inward as well. Moreover, the appendages 14 on one side 16 (or 20) of the body 12 may be operatively coupled to the appendages 14 on the other side 20 (or 16) of the body 12 such that when one or both appendages 14 on one side 16 of the body 12 are rotated downward and/or inward, the appendages 14 on the other side 20 of the body 12 also rotate downward and/or inward as well.

Figure 8:
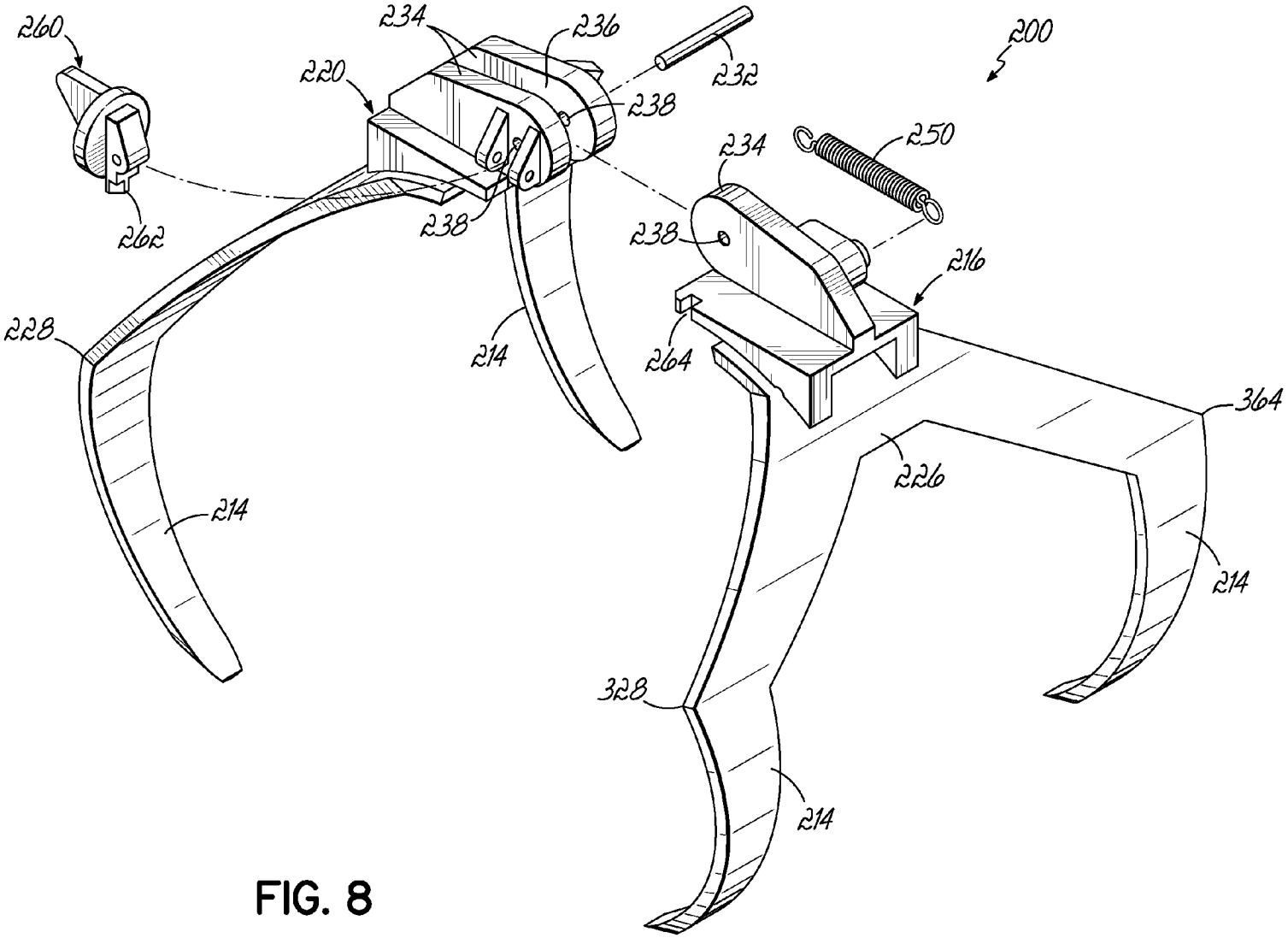
FIG. 8 is an exploded view of a shape changing apparatus in accordance with another embodiment of the invention.
Figure 9A:
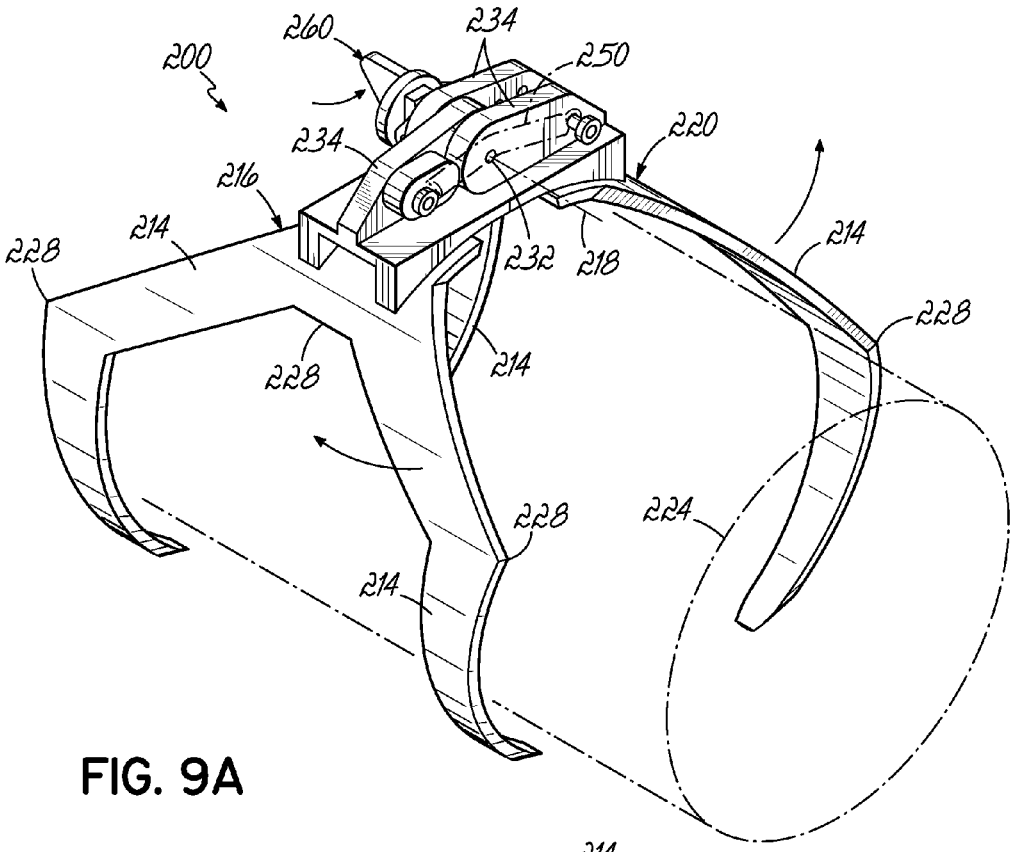
FIG. 9A is a perspective view of the apparatus of FIG. 8 in a closed position.
Figure 9B:
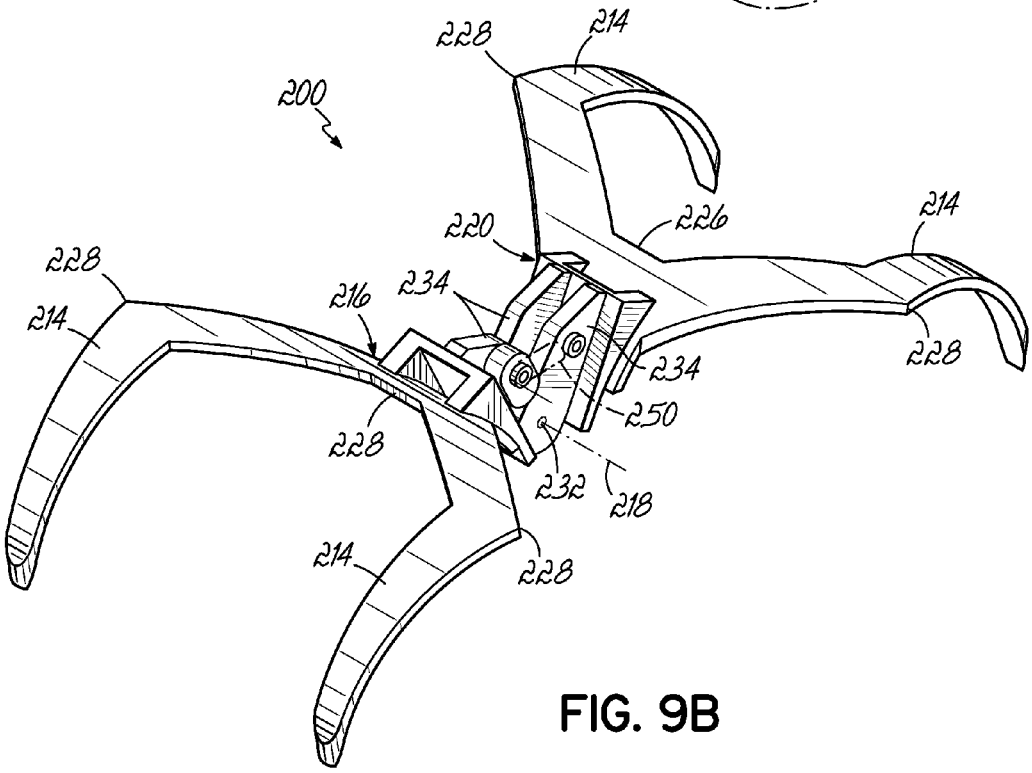
FIG. 9B is a perspective view of the apparatus of FIG. 8 in an open position.

The appendages 14 comprise a variety of shapes (e.g., a solid curve, an angled appendage having an "elbow" (FIG. 8), etc.), and the appendages 14 may have wings or fins 100 positioned thereon. In the embodiment shown in FIGS. 1-7B, each appendage 14 has an octagonal shaped fin 100 coupled to a lower surface 102 of the appendage 14. Alternatively, one of ordinary skill will recognize that the fin 100 may be positioned on an upper surface 104 of the appendage 14, and a size and shape of the fin 100 may vary. For example, in an alternative embodiment, the fin 100 may comprise a triangular shaped fin that extends perpendicularly from an upper surface 104 of the appendage 14. Moreover, the fin 100 may be solid or it may have one or more apertures extending therethrough. Depending on the weight, size, shape, and positioning of the fins 100 on the appendages 14, the fins 100 may affect the toy's 10 ability to land upright after launching and/or a launching distance.

In use, an operator of the shape changing toy 10 turns on the motor 70 with the switch. With the appendages 14 in the open position, the operator then positions the body 12 portion of the toy 10 adjacent the generally cylindrical object 24 such that the release mechanism 66 is positioned toward the operator (i.e., away from a desired launching direction). The operator then rotates at least one of the appendages 14 about its respective vertical axis 18, 22 so as to move the appendages 14 into the closed position, in which the appendages 14 at least partially encircle the generally cylindrical object 24. When the appendages 14 are in the closed position, the biasing mechanism (coil spring) 50 is stretched, and the retention mechanism 60 locks or secures the appendages 14 in the closed position. When the operator wishes to launch the toy 10, the operator activates the release mechanism 66 by applying a force substantially parallel to the axes of rotation 18, 22. With reference to FIG. 3A, once the release mechanism 66 is activated, the biasing mechanism 50 pulls the appendages 14 to the open position and launches the toy 10 off of the generally cylindrical object 24. When the toy 10 contacts the support surface on which it lands and the motor switch is in the "on" position, the motorized drive wheel 72 propels the toy 10 across the support surface. At this time, the operator may pick up the toy 10 to operate it again as described above or turn the motor 70 off via the switch.

With reference now to FIGS. 8-10B, another embodiment of the shape changing toy 200 is described. Unless indicated otherwise, the same description and reference numerals provided above with respect to the embodiment shown in FIGS. 1-7B are also applicable to this embodiment. As shown, the toy 200 includes four appendages 214, each being pivotally attached about a common axis of rotation 218. In this embodiment, the appendages 214 are directly coupled to one another, and thus, the toy 200 has no body portion. The appendages 214 are moveable between open and closed positions. As shown, the toy 200 has four appendages 214, but may include more or less appendages. Where there are multiple appendages 214 on a common side 216, 220 of the axis 218, like in FIG. 8, the appendages 214 are coupled to a common fork 226. As described with respect to the shape changing toy 10 in the embodiment of FIGS. 1-7B, the appendages 214 need not be positioned symmetrically with respect to the common axis of rotation 218.

The appendages 214 have generally arcuate shapes configured to fit around an object 224 which may support the toy 200 in a closed position. This object 224 may have a generally cylindrical shape like a body part, such as a wrist, an arm, a finger, a leg, and/or an ankle. However, a wide variety of objects may serve as the support. Moreover, as described above, the appendages 214 may comprise a variety of shapes and may have fins 100 positioned thereon. In the embodiment shown in FIGS. 8-10B, the appendages 214 include an angle that creates an elbow 228 on the appendage 214.

The forks 226 (or two appendages 214) are coupled together by a pin 232, which also serves as an axle at the common axis of rotation 218. One fork 226 includes two projections or loops 234 with a recess 236 therebetween, and the other fork 226 includes a single projection or loop 234 corresponding in size and shape so as to be positioned within the recess 236 of the first fork 226. In this way, the coupling between the forks 226 is similar to a butt hinge commonly used on doors. The projections 234 of the both of the forks 226 include aligned apertures, through which the pin 232 is inserted. One of ordinary skill will recognize that the number and position of the projections 234 may vary.

Figure 10A:
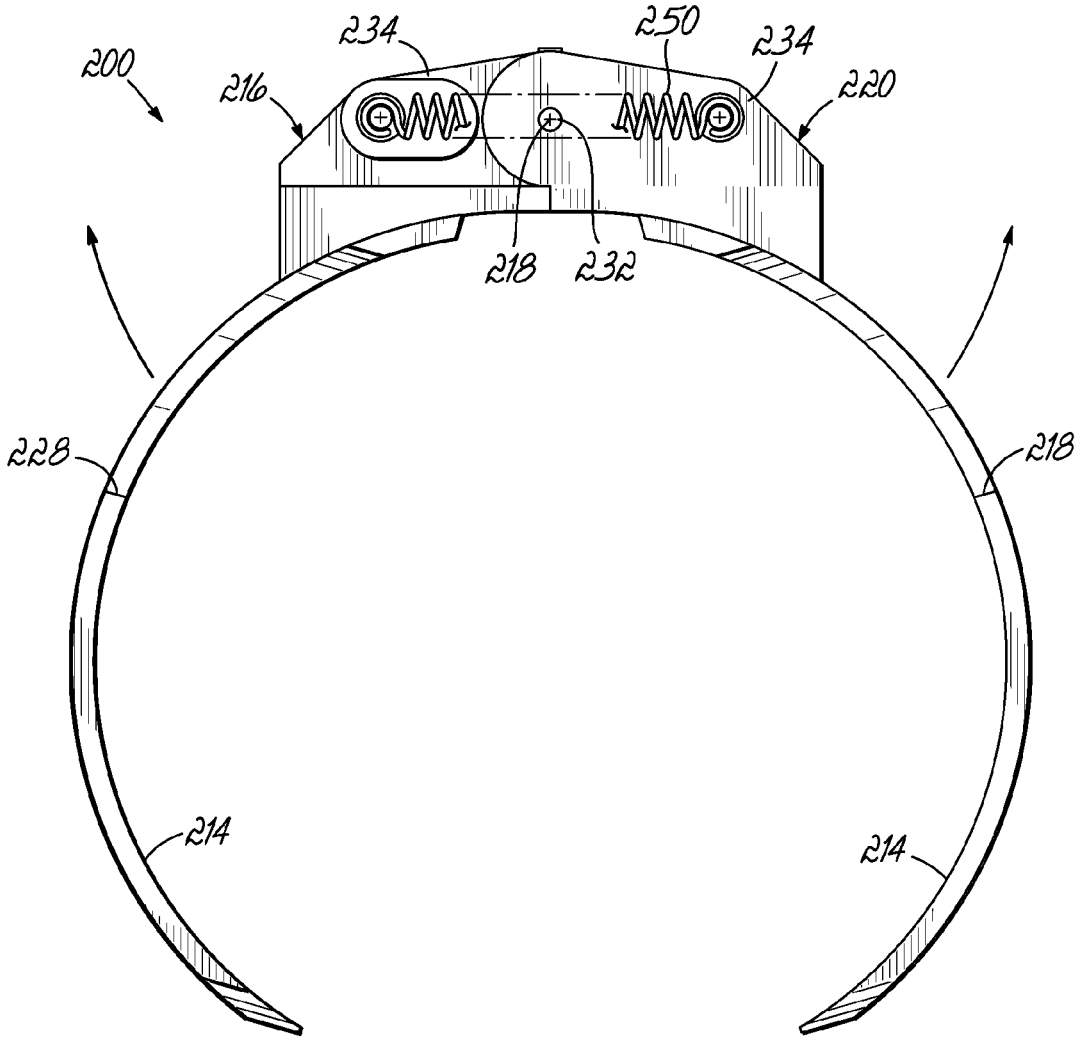
FIG. 10A is a cross section view of the apparatus of FIG. 8.
Figure 10B:
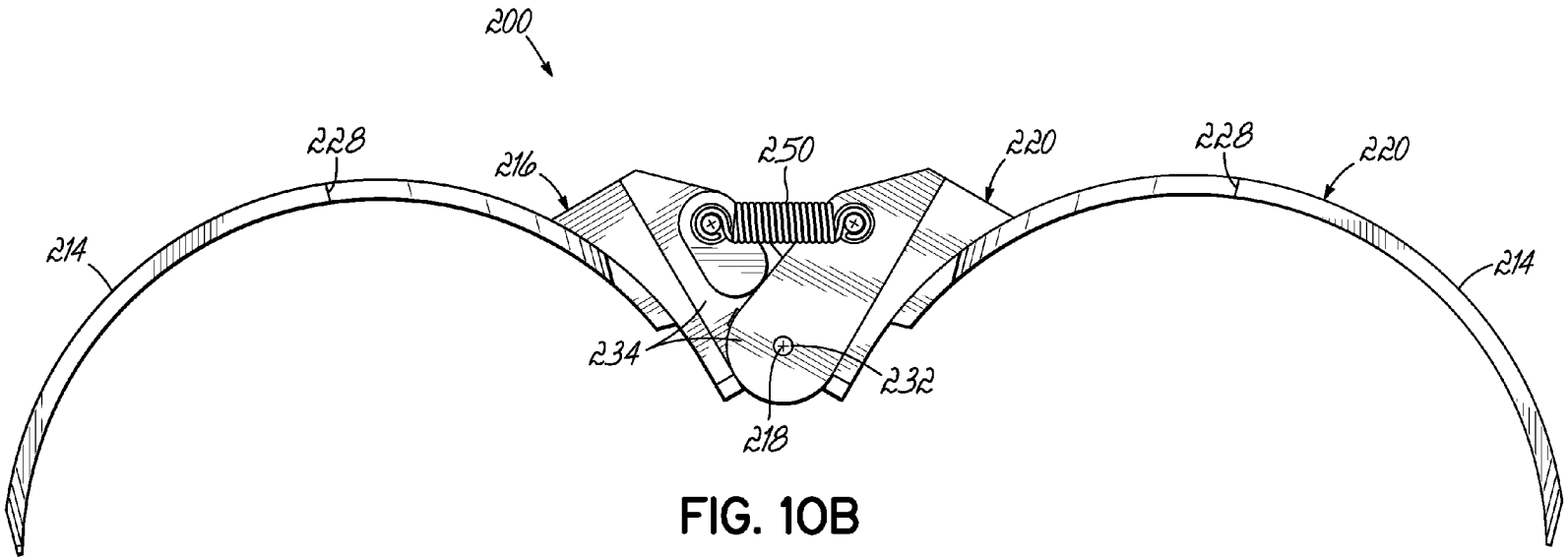
FIG. 10B is a cross section view of the apparatus of FIG. 8.

With specific reference to FIGS. 10A and 10B, a biasing mechanism 250 is coupled to a fork 226 (or an appendage 214) on each side 216, 220 of the common axis of rotation 218 based on similar mechanics to those described above. In the embodiment shown, the biasing mechanism, here a coil spring, 250 is positioned substantially perpendicular to the common axis of rotation 218. In the closed position, the biasing mechanism 250 may be stretched over the pin 232, which is substantially aligned with the common axis of rotation 218, to ensure that the biasing mechanism 250 vector remains at least partially above the common axis of rotation 218. In this configuration, the biasing mechanism 250 will tend to bias the appendages 214 to the open position, even when they are in the closed position.

As shown, the apparatus 200 includes a release mechanism or toggle button 260. The toggle button 260 has a small projection 262 extending from a bottom thereof that corresponds to a notch 264 in one of the forks 226 or appendages 214. When the appendages 214 are rotated to the closed position, the projection 262 enters the notch 264, whereby the appendages 214 are secured in the closed position and projection 262 prevents movement of the appendages 214 toward the open position. In this way, the release mechanism (or toggle button) 260 along with projection 262 act as a retention mechanism. The appendages 214 may be selectively released by pressing the toggle button 260, which pivots the projection 262 away from the notch 264. Similar to the push button 66 described above, the toggle button 260 may be activated by a force applied substantially parallel to the common axis of rotation 218. By applying the force to the toggle button 260 substantially parallel to the common axis of rotation 218, the operator's finger will not restrict the upward movement of the toy 200 away from the object 224.

In an alternative embodiment, the toy 200 may not include a release mechanism 260. In an embodiment that does not include any sort of a retention mechanism, the appendages 214 may simply remain in a closed position due to an interaction between the appendages 214 in the closed position. In the embodiment in which the toy 200 is positioned on an operator's wrist (i.e., the wrist is the generally cylindrical object 224), an operator simply flicks his wrist or slightly moves the appendages 214 apart to trigger the biasing mechanism 250 and move the appendages 214 to the open position. Without a retention or release mechanism 260, the biasing mechanism 250 may be very sensitive, requiring only a minimal force to bias the appendages 214 open.

With continued reference to the embodiment shown in FIGS. 8-10B, in use, an operator positions the toy 200 adjacent to a generally cylindrical object 224 such that the release mechanism 260 is positioned toward the operator (i.e., away from a desired launching direction). The operator then rotates at least one of the appendages 214 about the common axis 218 so as to move the appendages 214 into the closed position, in which the appendages 214 at least partially encircle the generally cylindrical object 224. When the appendages 214 are in the closed position, the biasing mechanism (here a coil spring) 250 is stretched, and the retention mechanism 260 locks or secures the appendages 214 in the closed position. When the operator desires to launch the toy 200, the operator activates the release mechanism 260 by applying a force substantially parallel to the common axis of rotation 218. With reference to FIG. 9A, once the release mechanism 260 is activated, the biasing mechanism 250 pivots the appendages 214 to the open position and launches the toy 200 off of the generally cylindrical object 224.

One of ordinary skill will recognize that additional features may be added to this embodiment of the shape changing toy 200, including, but not limited to, the appendages 214 being coupled to the fork 226 at axes of rotation 80 different than the common axis of rotation 218 so as to provide lateral movement of the appendages 214 or the addition of a motor 70 and drive wheel assembly 72, as described above.

Figure 11:
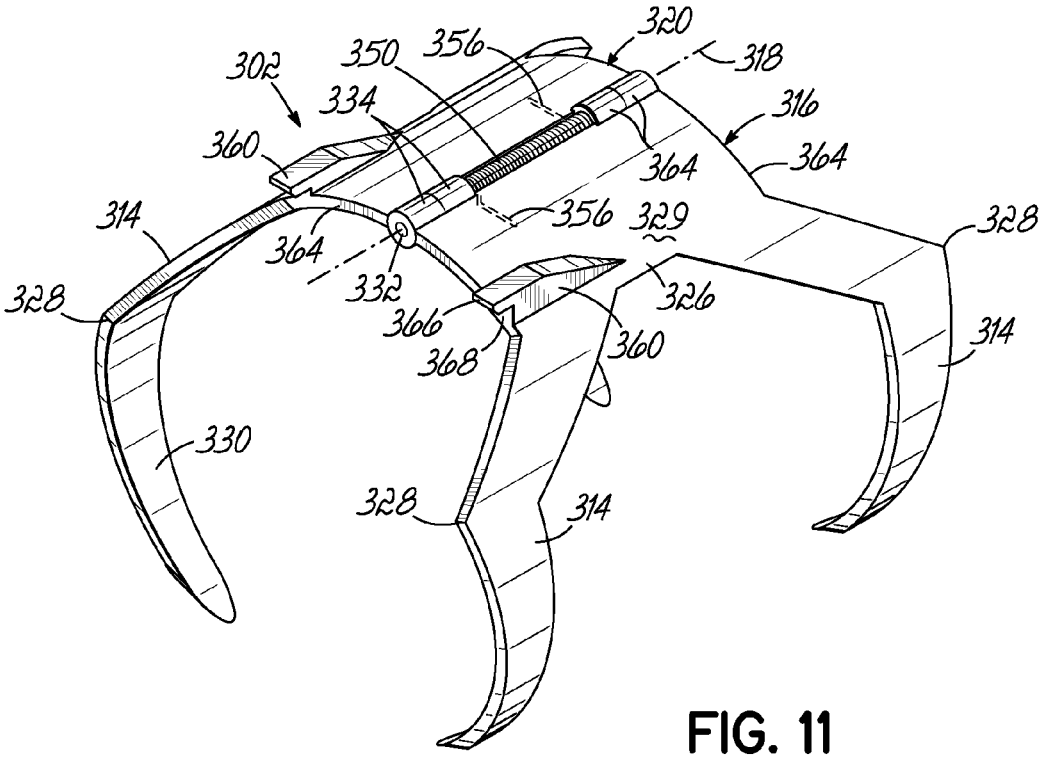
FIG. 11 is a perspective view of a shape changing apparatus in accordance with yet another embodiment of the invention.
Figure 12:
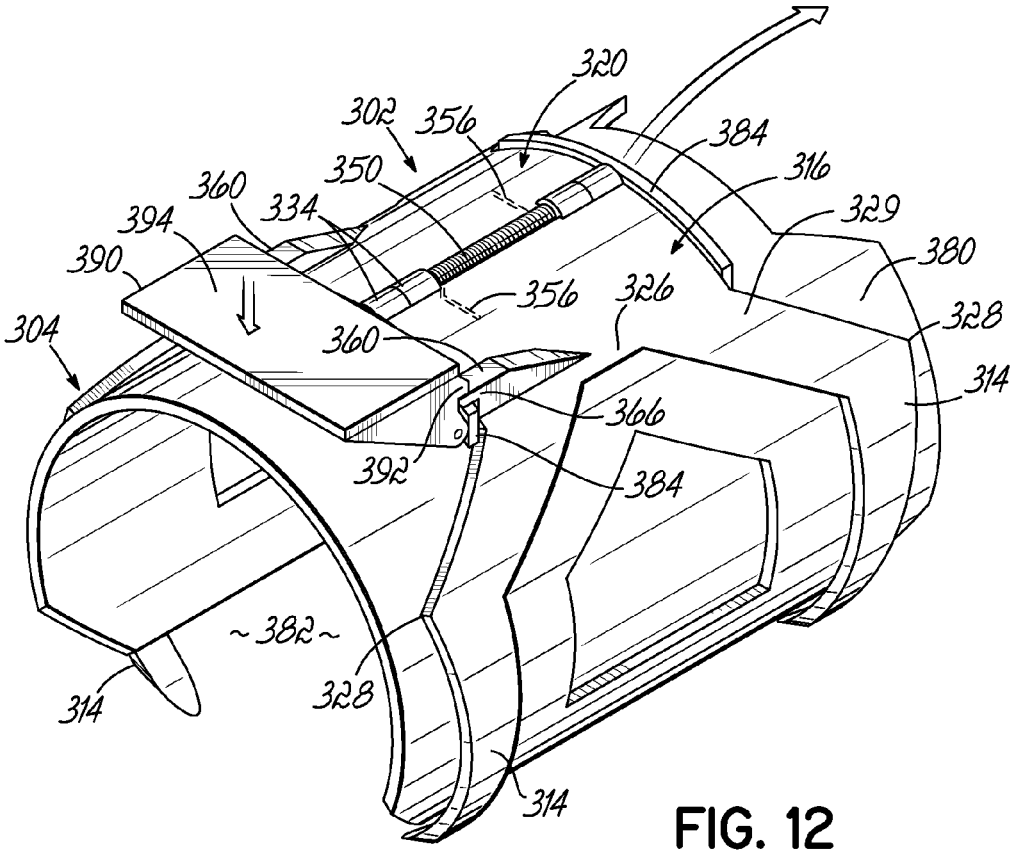
FIG. 12 is a perspective view of an assembly including the apparatus of FIG. 11 in a closed position.
Figure 13:
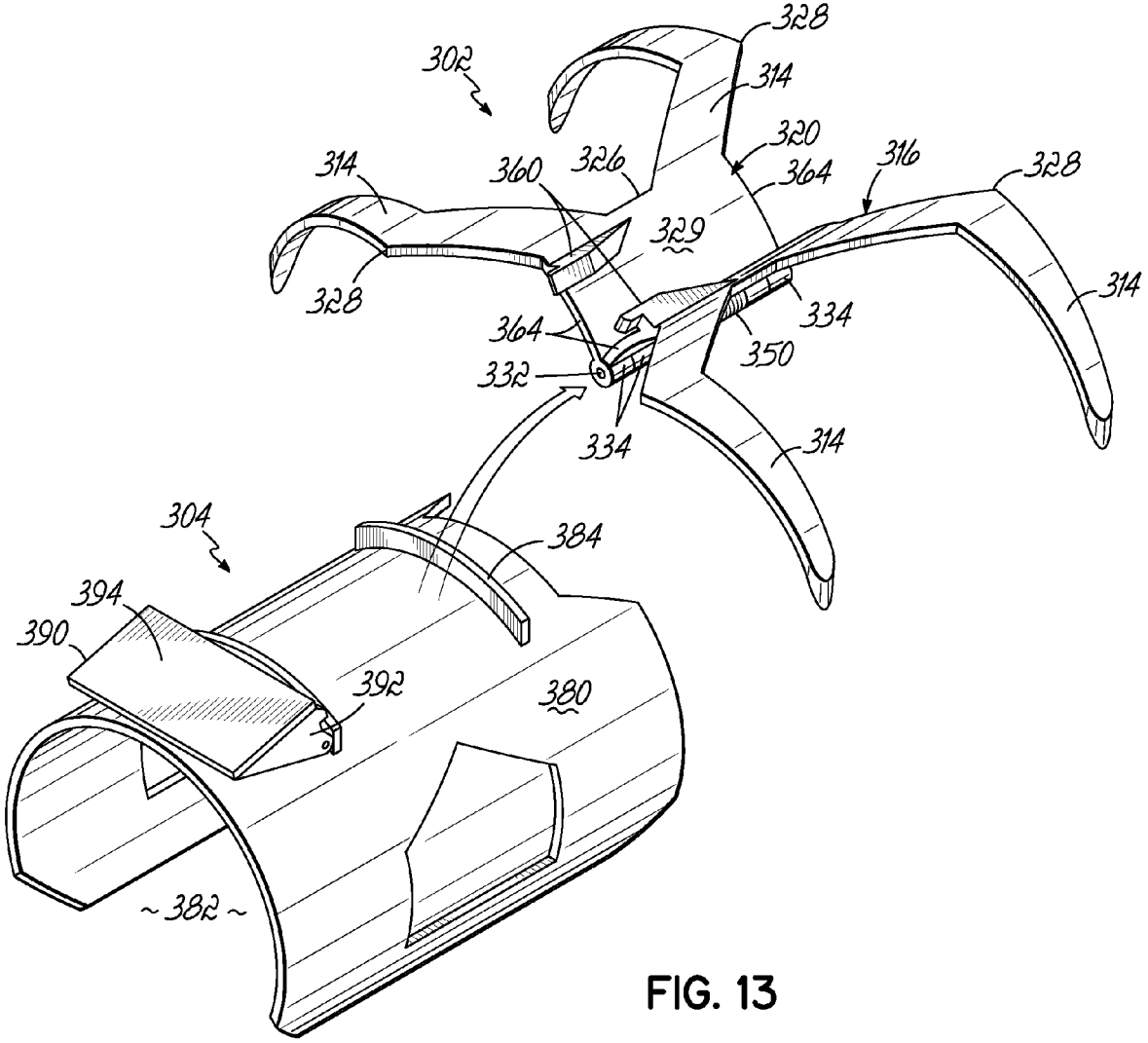
FIG. 13 is a perspective view of the assembly of FIG. 12 including the apparatus of FIG. 11 in an open position.

With reference now to FIGS. 11-13, a shape changing toy assembly 300 is described. The assembly 300 includes an embodiment of a shape changing toy 302 and a launching dock 304. Unless indicated otherwise, the same description and reference numerals provided above with respect to the embodiments shown in FIGS. 1-10B are also applicable to this embodiment. As shown, the toy 302 includes two appendages 314 pivotally attached to one another about a common axis of rotation 318. The appendages 314 are moveable between open and closed positions. Alternatively, the toy 302 may comprise more than two appendages 314, in which case the appendages 314 on a common side 316, 320 of the axis of rotation 318 are located on a fork 326. As described with respect to the shape changing toy 10 in the embodiment of FIGS. 1-7B, the plurality of appendages 314 may include any number of appendages 314, and it is not necessary that the appendages 314 be positioned symmetrically with respect to the common axis of rotation 218.

The appendages 314 have generally arcuate shapes that are configured to fit around a generally cylindrically shaped launching dock 304 (described in further detail below) that can support the toy 302 in a closed position. Moreover, as described above, the appendages 314 may comprise a variety of shapes and may have fins 100 positioned thereon. In the embodiment shown in FIGS. 11-13, similar to the embodiment shown in FIGS. 8-10B, the appendages 314 include an angle that creates an elbow 328 on the appendage 314. The forks 326 (and the corresponding appendages 318) have an upper surface 329 and a lower surface 330.

In an embodiment, the forks 326 are coupled together by a pin 332 that also serves as an axle at the common axis of rotation 318. Each fork 326 includes a loop 334 proximate each end thereof. The loops 334 of one fork 326 are offset from and are complementary to the loops 334 of the other fork 326. Each loop 334 includes an aperture, and the apertures of the loops 334 of both forks 326 are aligned when the forks 326 are coupled together. A pin 332 is inserted through the apertures of all four loops 334 so as to create the common axis of rotation 318. In this way, the coupling between the forks 326 is similar to a butt hinge commonly used on doors. One of ordinary skill will recognize that the number and positions of the loops 334 may vary.

The toy 302 further includes a biasing mechanism 350. In this embodiment the biasing mechanism 350 is a torsion spring. One end of the biasing mechanism or torsion spring 350 is coupled to the fork 326 or appendage 314 on one side 316 of the common axis of rotation 318, and the other end of the biasing mechanism or torsion spring 350 is coupled to the appendage 314 or fork 326 on the other side 320 of the common axis of rotation 318. The biasing mechanism 350 is configured to bias the appendages 314 to the open position. In FIGS. 11-13, the torsion spring includes a leg 356 (shown in phantom) at each end thereof. The torsion spring 350 is positioned over the pin 332 (i.e., the pin 332 is positioned inside of the torsion spring 350), such that the torsion spring 350 is positioned substantially concentrically with the pin 332 and the common axis of rotation 318.

The toy 302 further includes at least one retention tab 360 positioned on at least one fork 326 or appendage 314. In the embodiment shown in FIGS. 11-13, one retention tab 360 is positioned on each of the forks 326. Each retention tab 360 is elevated above an upper surface 329 of the fork 326 and extends at least partially past an edge 364 of the fork 326 so as to create an overhang 366. A recess 368 is located below the overhang 366. The retention tabs 360 are configured to cooperate with a retention mechanism 370, which will be described in further detail below.

Turning now to the launching dock 304 shown in FIGS. 12 and 13, the launching dock 304 is configured to serve as a support surface for the toy 302 in the closed position. The launching dock 304 may comprise a generally cylindrical shape or any other shape that generally corresponds in shape and size to appendages 314 in the closed position. An upper surface 280 of the launching dock 304 is shaped and sized so as to be generally complementary to lower surfaces 330 of the forks 326 and the appendages 314 in the closed position.

In an embodiment, the launching dock 304 is configured to be positioned on a generally cylindrical object 326, such as an operator's wrist, arm, finger, leg, or ankle, for example. In this way, the launching dock 304 is similar to a cuff style bracelet. As shown, the launching dock 304 includes an opening 382 at a bottom portion thereof so as to permit the operator to simply slide the launching dock 304 on and off his or her wrist, for example. One of ordinary skill will recognize, however, that the launching dock 304 may have a variety of configurations, including a variety of closing mechanisms for putting on and/or removing the launching dock 304 from the generally cylindrical object 326. For example, the launching dock 304 may include a hinge (not shown) that permits the launching dock 304 to be opened and closed. In an alternative embodiment, the launching dock 304 may be configured or used as a free standing apparatus that is not positioned or worn on another object.

The launching dock 304 further includes the retention mechanism 370 configured to cooperate with the at least one retention tab 360 for securing the toy 302 to the launching dock 304 while the first and second appendages 314 are in the closed position. As part of the retention mechanism 370, the upper surface 380 of the launching dock 304 may include two raised rails 384 positioned proximate opposite ends of the launching dock 304. The rails 384 generally correspond to the shape and size of the edges 364 of the forks 326. The rails 384 are configured to abut the edges 364 of the forks 326 and serve as aids for positioning the toy 302 on the launching dock 304. One of the rails 384 corresponds in size and shape to the recess 368 below the overhang 366 in the at least one retention tab 360. When the toy 302 is positioned on the launching dock 304 in the closed position, the overhang 366 of the retention tab 360 abuts and extends over the rail 384.

The retention mechanism 370 further includes a pivoting button 390 that is coupled to or coupled adjacent to the rail 384. The pivoting button 390 may be pivoted between a locked position, in which it is in contact with the toy 302, and an unlocked position, in which it is not in contact with the toy 302. At least one tab-like extension 392 protrudes from an end of the pivoting button 390 so as to extend in a spaced position above the rail 384 in the locked position. The extension 392 is configured to cooperate with the retention tab 360 such that when the overhang 366 of the retention tab 360 abuts and extends over the rail 384 when the toy 302 is in the closed position on the launching dock 304, the extension 392 extends over the retention tab 360 to hold the appendages 314 of the toy 302 in the closed position. The pivoting button 390 is generally biased toward the locked position. In this way, the pivoting button 390 is forced away from the rail 384 when the appendages 314 of the toy 302 are closed around the launching dock 304, and then the tab-like extension 392 of the pivoting button 390 biases back toward the rail 284 to extend over the retention tab 360.

The retention mechanism 370 also includes an actuator for selectively releasing the retention mechanism 370. In an embodiment, the actuator may comprise a top surface 394 of the pivoting button 390 that is positioned in spaced relation to the upper surface 380 of the launching dock 304 when the pivoting button 390 is in the locked position. The pivoting button 390 is configured to be actuated when a downward force (i.e., a force substantially perpendicular to the common axis of rotation 318) is applied to the top surface 394 thereof. When the pivoting button 390 is actuated, the button 390 pivots away from the rail 384, and the tab-like extension 392 moves out of contact with the retention tab 360. As such, the retention mechanism 370 is released, which permits the appendages 314 to move from the closed position to the open position so as to launch the toy 302 from the launching dock 304.

One of ordinary skill will recognize that additional features may be added to this particular embodiment of the shape changing toy 302, including, but not limited to, the appendages 314 being coupled to the fork 326 at axes of rotation 80 different than the common axis of rotation 318 so as to provide lateral movement of the appendages 314 or the addition of a motor 70 and drive wheel assembly 72, as described above.

With continued reference to FIGS. 11-13, in use, the launching dock 304 is positioned on a generally cylindrical object 326, such as a wrist or a support surface. The end of the launching dock 304 on which the pivoting button 390 is located should be positioned opposite the desired direction of launching. In the embodiment in which the launching dock 304 is positioned on an operator's wrist or other appendage of the operator's body, the end of the launching dock 304 with the pivoting button 390 is positioned proximal the operator's body such that the toy 302 will launch away from the operator's body.

The shape changing toy 302 is then positioned adjacent an upper surface 380 of the launching dock 304. The end of the toy 302 on which the retention tab 360 is located is positioned proximate the pivoting button 390. The toy 302 is guided into a proper position on the launching dock 304 by aligning the edges 364 of the forks 326 with the rails 284 and positioning the toy 302 within the rails 384. The operator then moves at least one of the appendages 314 into the closed position by rotating the appendage 314 about the common axis of rotation 318. When the appendages 314 are in the closed position, they at least partially encircle the launching dock 304. When the retention tab 360 of the toy 302 comes to rest on the rail 384, the extension 392 of the pivoting button 390 is biased toward the rail 384 and snaps into locking position, such that the extension 392 is positioned above the overhang 366 of the retention tab 360. Accordingly, the retention mechanism 370 secures the appendages 314 in the closed position.

When the operator desires to launch the toy 302, the operator exerts a downward force on the pivoting button 390 so as to pivot the extension 392 out of contact with the retention tab 360. Accordingly, as shown in FIG. 13, the biasing member 350 of the toy 302 biases the appendages 314 toward the open position, and the toy 302 is launched from the launching dock 304.

With respect to each of the embodiments described above, one of ordinary skill will recognize that the aspects of the invention described above may be combined in a wide variety of embodiments not explicitly described above. Moreover, the shape changing toy and/or the launching dock may be designed and decorated to create a wide variety of appearances. For example, in an embodiment, the toy may have eight appendages, and the body portion and the appendages may be designed to resemble a spider. As another example, the toy may have two wide appendages that are designed to look like wings. As such, the toy may be designed and decorated to resemble a butterfly, a bumblebee, a bird, etc. In yet another example, the toy may have four or more petal shaped appendages, and the toy may be designed and decorated to resemble a flower. One of ordinary skill will recognize almost limitless creative options for the design and decoration of the shape changing toy.

While the present invention has been illustrated by the description of specific embodiments thereof, and while these embodiments have been described in considerable detail, they are not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A shape changing apparatus, comprising:

a body portion having first and second opposing sides;

first and second appendages pivotally attached to respective first and second sides of the body portion so as to be rotatable about respective first and second axes of rotation, each appendage having a generally arcuate shape, the first and second appendages being moveable between an open position and a closed position;

a biasing mechanism coupled to the first and second appendages, the biasing mechanism being configured to bias the first and second appendages to the open position; and a release mechanism operatively coupled to one of the first or second appendages, wherein each of the first and second appendages is coupled to respective first and second opposing intermeshing gears so that the first and second appendages move in unison between the open and closed positions, wherein upon activating the release mechanism the biasing mechanism pivots the first and second appendages to the open position.

2. The shape changing apparatus of claim 1, further comprising:

a motor associated with the body portion; and at least one drive wheel operatively coupled to the motor and extending at least partially out of the body portion, wherein the motor powers the at least one drive wheel to propel the shape changing apparatus across a support surface when the first and second appendages are in the open position.

3. The shape changing apparatus of claim 2, further comprising:

a switch operatively connected to the motor, the switch being configured to deactivate the motor when the first and second appendages are in the closed position, the switch being configured to activate the motor as the first and second appendages move from the closed position to the open position.

4. The shape changing apparatus of claim 1, wherein the release mechanism is configured to be activated by a force vector substantially parallel to the first and second axes of rotation.

5. The shape changing apparatus of claim 1, further comprising:

third and fourth appendages pivotally attached to respective first and second sides of the body so as to be rotatable about respective first and second axes of rotation, each appendage having a generally arcuate shape, the third and fourth appendages being moveable between the open and closed positions.

6. The shape changing apparatus of claim 5, wherein the first and third appendages are coupled together so that they move in unison between the open and closed positions and the second and fourth appendages are operatively coupled together so that they move in unison between the open and closed positions.

7. The shape changing apparatus of claim 6, wherein each of the four appendages is configured to rotate about a different respective axis not aligned with either of the first and second axes of rotation.

8. The shape changing apparatus of claim 1, wherein at least one of the first and second appendages is configured to rotate about a third axis not aligned with either of the first and second axes of rotation.

9. The shape changing apparatus of claim 1, further comprising:

a retention mechanism is operably coupled to the release mechanism, the retention mechanism being configured to help secure the first and second appendages in the closed position.

10. The shape changing apparatus of claim 1, wherein the arcuate shaped first and second appendages are configured to fit around a generally cylindrical object when the first and second appendages are in the closed position.

11. The shape changing apparatus of claim 10, wherein the arcuate shaped first and second appendages are configured to fit around a wrist, an arm, a finger, a leg or ankle, when the first and second appendages are in the closed position.

12. A shape changing apparatus, comprising:

first and second appendages pivotally attached to one another about a common axis of rotation, each appendage having a generally arcuate shape, the first and second appendages being moveable between an open position and a closed position;

a biasing mechanism having first and second ends coupled to respective first and second appendages, the biasing mechanism being configured to bias the first and second appendages to the open position; and a release mechanism operatively coupled to one of the first or second appendages, the release mechanism including a retention mechanism to help secure the first and second appendages in the closed position;

wherein upon activating the release mechanism the biasing mechanism pivots the first and second appendages to the open position.

13. The shape changing apparatus of claim 12, wherein the arcuate shaped first and second appendages are configured to fit around a generally cylindrical object when the first and second appendages are in the closed position.

14. The shape changing apparatus of claim 12, wherein the arcuate shaped first and second appendages are configured to fit around a wrist, an arm, a finger, a leg, or an ankle when the first and second appendages are in the closed position.

15. The shape changing apparatus of claim 12, wherein the release mechanism is configured to be activated by a force vector substantially parallel to the common axis of rotation.

16. An assembly, comprising:

a shape changing apparatus including:

first and second appendages attached to at least one axis of rotation, each appendage having a generally arcuate shape, the first and second appendages being moveable between an open position and a closed position;

a biasing mechanism having first and second ends coupled to respective first and second appendages, the biasing mechanism being configured to bias the first and second appendages to the open position; and at least one retention tab positioned on one of the first and second appendages; and a launching dock including an apparatus retention mechanism configured to cooperate with the retention tab for securing the apparatus to the launching dock while the first and second appendages are in the closed position, the apparatus retention mechanism including an actuator for selectively releasing the retention mechanism to permit the first and second appendages to move from the closed position to the open position thereby launching the apparatus from the launching dock.

17. The assembly of claim 16, wherein the launching dock is configured to be worn on at least one of the following: a wrist, an arm, a finger, a leg, and an ankle

18. The assembly of claim 16, wherein the shape changing apparatus further includes a body portion having first and second opposing sides, wherein the first and second appendages pivotally attached to respective first and second sides of the body portion.

19. The assembly of claim 16, wherein the first and second appendages pivotally attach to one another about a single axis of rotation.

20. A method of operating a shape changing apparatus including a body portion having first and second opposing sides, first and second appendages attached to respective first and second sides of the body so as to be rotatable about respective first and second axes of rotation, each appendage having a generally arcuate shape, the first and second appendages being moveable between an open position and a closed position, a biasing mechanism having first and second ends coupled to respective first and second appendages, the biasing mechanism configured to bias the first and second appendages to the open position, and a release mechanism operatively coupled to one of the first and second appendages, the method comprising:

positioning the body portion adjacent a generally cylindrically object;

moving at least one of the first and second appendages into the closed position such that the first and second appendages at least partially encircle the generally cylindrical object and the biasing mechanism is stretched; and activating the release mechanism such that the biasing mechanism pivots the first and second appendages to the open position and the apparatus moves away from the cylindrical object.

21. The method of claim 20, wherein the release mechanism is activated by applying a force substantially parallel to the first and second axes of rotation.

22. The method of claim 20, the apparatus further comprising third and fourth appendages pivotally attached to respective first and second sides of the body so as to be rotatable about respective first and second axes of rotation, each appendage having a generally arcuate shape, the third and fourth appendages being moveable between the open and closed positions, wherein each of the four appendages is configured to rotate about a different respective axis not aligned with either of the first or second axes of rotation.

23. A method of operating a shape changing apparatus having first and second appendages pivotally attached to one another about a common axis of rotation, each appendage having a generally arcuate shape, the first and second appendages being moveable between an open position and a closed position, a biasing mechanism having first and second ends coupled to respective first and second appendages, the biasing mechanism configured to bias the first and second appendages to the open position, and a release mechanism operatively coupled to one of the first or second appendages, the method comprising the steps of:

positioning the shape changing apparatus adjacent a generally cylindrically object;

moving at least one of the first and second appendages into the closed position such that the first and second appendages at least partially encircle the generally cylindrical object and the biasing mechanism is stretched; and activating the release mechanism such that the biasing mechanism pivots the first and second appendages to the open position and the apparatus moves away from the cylindrical object.

24. The method of claim 23, wherein the release mechanism is activated by applying a force substantially parallel to the common axis of rotation.

25. A method of operating an assembly having a shape changing apparatus including first and second appendages attached to about at least one axis of rotation, each appendage having a generally arcuate shape, the first and second appendages being moveable between an open position and a closed position, a biasing mechanism coupled to the first and second appendages, the biasing mechanism configured to bias the first and second appendages to the open position, and at least one retention tab positioned on at least one of the first and second appendages, the assembly further having a launching dock including an apparatus retention mechanism configured to cooperate with the retention tab, the apparatus retention mechanism including an actuator for selectively releasing the retention mechanism, the method comprising:

positioning the shape changing apparatus adjacent the launching dock;

moving at least one of the first and second appendages into the closed position such that the first and second appendages at least partially encircle the launching dock;

securing the retention tab in the retention mechanism when the first and second appendages are in the closed position; and actuating a release of the retention member such that the biasing mechanism pivots the first and second appendages to the open position thereby launching the apparatus from the launching dock.

* * * * *